US006030149A

United States Patent [19]

Foo et al.

[11] Patent Number: 6,030,149

[45] Date of Patent: Feb. 29, 2000

[54] SELF POSITIONING FIXATION SYSTEM AND METHOD OF USING THE SAME

[75] Inventors: Kok Seng Foo; Govind Raghunath Rege, both of Singapore, Singapore

[73] Assignees: Offshore Technology Development Pte Ltd, Singapore; Amfels, Inc., Brownsville, Tex.

[21] Appl. No.: 08/721,116

[22] Filed: Sep. 26, 1996

[30] Foreign Application Priority Data

Oct. 13, 1995 [SG] Singapore ..... 9501539-2

[51] Int. Cl.[7] ..... B66F 1/04; E02B 17/08

[52] U.S. Cl. ..... 405/199; 254/112; 405/198

[58] Field of Search ..... 405/198, 199; 254/105, 112

[56] References Cited

U.S. PATENT DOCUMENTS

| | | | |
|---|---|---|---|
| Re. 32,589 | 2/1988 | Goldman et al. | 405/198 |
| 4,255,069 | 3/1981 | Yielding | 405/196 |
| 4,389,140 | 6/1983 | Bordes | 405/195.1 |
| 4,447,401 | 5/1984 | Casperson et al. | 422/151 |
| 4,538,938 | 9/1985 | Grzelka et al. | 405/198 |
| 4,589,799 | 5/1986 | Hotta et al. | 405/196 |
| 4,662,787 | 5/1987 | Tatsuguchi | 405/198 |
| 4,813,814 | 3/1989 | Shibuta et al. | 405/198 |
| 5,139,366 | 8/1992 | Choate et al. | 405/198 |
| 5,188,484 | 2/1993 | White | 405/198 |
| 5,486,069 | 1/1996 | Breeden | 405/198 |

FOREIGN PATENT DOCUMENTS

| | | |
|---|---|---|
| 2 081 674 | 2/1982 | Germany . |
| 2 160 824 | 1/1986 | Germany . |

*Primary Examiner*—Tamara L. Graysay
*Assistant Examiner*—Tara L. Mayo
*Attorney, Agent, or Firm*—Lawrence Y.D. Ho; David D. Chung; Jacqueline C.T. Lui

[57] ABSTRACT

The present invention has at least one rack chock which is supported pivotally and tiltably at one end by a pin and cross head assembly located at a position between at least one leg rack and the hull of the platform. The other end of the rack chock is connected to the jack foundation with an actuator assembly. The pin and cross head assembly is disposed slidably within a guide for permitting the teeth of the rack chock to engage the leg rack teeth without visual monitoring and manual control. The actuator assembly connected to the other end of the rack chock controls the swinging movement of the rack chock and its engagement and disengagement with the leg rack. A pair of jacks urges upper and lower wedges with tiltable surfaces converging onto the rack chord's upper and lower surfaces, thus obtaining a optimal surface to arrest the relative movement between the rack chock and the leg rack. As such, load from the jack foundation is transferred to the legs, overturning moments on the legs to the jack foundation. Stress to the mating surfaces of the present invention and the leg rack is minimized as the engagement of the present invention takes place under load from the inertia load of the rack chock due to the pivoting action with minimum forcing action from the actuator assembly.

15 Claims, 6 Drawing Sheets

SELF POSITIONING FIXATION SYSTEM AND METHOD OF USING THE SAME

FIELD OF THE INVENTION

The present invention relates to a fixation system for self elevating platform or jackup rig. In particular, the present invention pertains to a system for automatically engaging the fixation device to arrest the relative movement between the supporting legs and hull of self elevating platform while preserving surface integrity of the mating surfaces.

BACKGROUND OF THE INVENTION

Various prior art fixation systems are employed to arrest the relative motions and transfer the overturning moments and loads between the hull and legs of a jackup rig.

A jackup rig as used herein means any working platform for drilling, work over, production, crane work, compressor station, diving support or other offshore purpose in an elevated position above the water, and being supported on jackable legs to the ocean floor or other water bottom, with the inherent capability of relocating from one site to another by lowering to a floating position, and after being moved to a new established location, raising again to an elevated position. Jackup rigs are equipped with rack and pinion jacking systems for raising and lowering the platform. The rack is fixed to the leg along its vertical length, and pinions and their drives are disposed on the jacking units' structures which are connected to the hull.

The first type of fixation systems use stoppers or lock bolts which individually engage with and lock into the tooth spaces or on the tooth flanks of the rack on the leg. These stoppers can be moved individually or as group by actuators. However, the individual stopper is capable of adjusting its position when it meshes with the tooth spaces of the rack. Exemplary of the first type of fixation systems are U.S. Pat. Nos. 4,447,401, 4,813,814, and 5,139,366. Each of these systems requires manual intervention during engagement notwithstanding certain automation features. Where the movement of stoppers is in a direction substantially perpendicular to the leg rack, the stoppers may not engage fully into the tooth space in all relative positions of the hull with respect to the leg.

By rack chock fixation system, the present invention refers to a system for aligning and locking a section of rack chock with a profile matching the teeth of the rack on the jackable legs. U.S. Pat. No. Re. 32,589 exemplifies the rack chock fixation system where a series of vertical and horizontal screw jacks align a rack chock piece with flat upper, lower and lateral surfaces with a matching teeth profile on the leg rack. The alignment is accomplished manually and visually. Once aligned, the rack chock and the leg rack are locked by screw jacks.

Another type of locking fixation system for jackup rig is exemplified by U.S. Pat. No. 4,389,140 which teaches the use of a rack chock with inclined upper and lower surfaces with flange edges held between claws of vertically movable wedges with mating surface and matching inclination. The wedges are guided to move vertically by nuts fixed into the wedges; the rack piece is engaged with mating teeth on the leg rack by independent rotating screws. Rotation of the screws with identical speed in the same direction moves the wedges as well as the rack vertically. Rotation of the screws with identical speed in the opposite direction brings the wedges closer and moves the rack piece laterally by sliding along the inclined surfaces. Similarly the locking fixation system requires visual monitoring for the exact matching of the rack chock with the teeth of the leg rack.

The third type of fixation system for jackup rigs is typified in U.S. Pat. No. 4,662,787 which teaches the use of a rack chock with inclined upper and lower surfaces having flanged edges held between claws of horizontally movable wedges with mating surface and matching inclination. Wedge guides in the framework (attached rigidly to the hull) guided the wedges, while independent screwjacks acting against the flat end of the wedges provided movement to it. Rotation of the screwjacks in opposing directions with the same speed moves the rack chock vertically. Rotation of the screwjacks in the same direction moves the inclined surfaces of the wedges towards or away from each other, thus moving the rack chock toward or away from the leg rack by sliding along the inclined faces of the wedges.

All three types of prior art fixation system employ combinations of rack chocks, wedges, and jacks to arrest the relative movements between legs and hull as well as to transfer the loads in a self elevating platform. It can also be said that all prior art fixation systems require visual monitoring for the exact meshing of the teeth of the rack chock with the teeth of the leg rack.

OBJECT OF THE INVENTION

It is an object of the present invention to provide a new fixation system for self elevating platform or jackup rig without relying on visual monitoring and manual control to align and engage the rack chock to the leg rack.

It is another object of the present invention to provide a new fixation system for self elevating platform which incorporates a rack chock supported at one end pivotally and tiltably by at least one pin and cross head assembly disposed between the leg rack and the hull of the platform for aligning the rack chock with the leg rack without visual monitoring and manual control.

It is yet another object of the present invention to provide a new fixation system for self elevating platform having a slidable pin supported within a slidable cross head which in combination with the pivotally supported rack chock self positions the teeth of the rack chock with the leg rack teeth during engagement even when the leg assembly has angular misalignment with the rack chock in any direction.

It is a further object of the present invention to provide a new fixation system for self elevating platform which will successfully transfer the load from the jack foundation to the leg assembly or vice versa even when the leg assembly has angular misalignment with the rack chock in any direction.

It is a further object of the present invention to provide a new fixation system for self elevating platform which automatically engages and disengages with the leg rack while preserving surface integrity of the mating surfaces.

It is yet a further object of the present invention to provide a new fixation system for self elevating platform which incorporates wedges with tiltable surface converging onto the mating surfaces of the rack chock to enable optimal surface contact for load transfer.

SUMMARY OF THE INVENTION

The present invention has at least one rack chock which is supported pivotally and tiltably at one end by at least one pin located at a position between at least one leg rack and the hull of the platform. The other end of the rack chock is connected to the jack foundation with an actuator assembly. The pin is disposed rotatably between a pair of cross heads which in turn are disposed slidably within a guide. The cross heads are maintained in an equilibrium position for the rack chock to engage the leg rack teeth by a pair of springs within the guide. Thus, the pin and cross head assembly enables the teeth of the rack chock to engage the leg rack teeth without visual monitoring and manual control. The actuator assembly connected to the other end of the rack controls the swinging movement of the rack chock and its engagement and disengagement with the leg rack. A pair of opposing jacks urge upper and lower wedges with tiltable surfaces converging onto the upper and lower surfaces of the rack chock in arresting the relative movement between the rack and the leg rack. As such, load from the jack foundation is transferred to the legs, overturning moments on the legs to the jack foundation. Stress to the mating surfaces of the present invention and the leg rack is minimized as the engagement of the present invention takes place without any misalignment between the rack chock and the leg rack.

DESCRIPTION OF THE EMBODIMENT OF THE INVENTION

Figure 1:
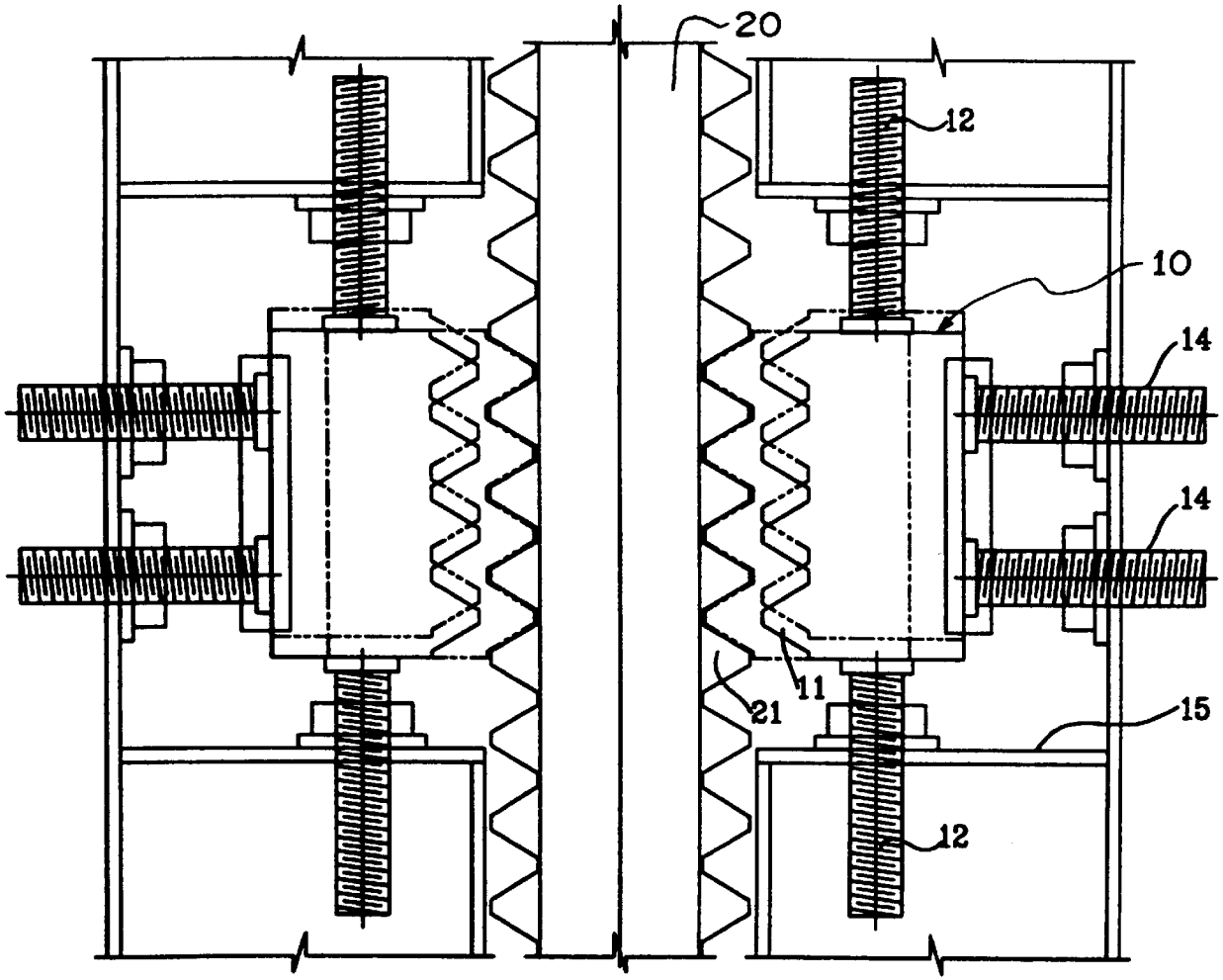
FIG. 1 (PRIOR ART)
FIG. 1 is a side, elevational view of a prior art rack chock fixation system for jackup rig.

A method and apparatus for positioning a fixation device automatically and arresting the relative movement between the supporting legs and hull of self elevating platform is described. In the following description, numerous specific details are set forth such as rack, pin and program steps, etc. in order to provide a thorough understanding of the present invention. It will be obvious to one skilled in the art that the present invention may be practiced without these specific details. In other instances, well-known parts such as those involved with the rack and pinion jacking system are not shown in order not to obscure the present invention.

Notation and Nomenclature

The detailed description with respect to the steps of positioning automatically the rack to the leg rack are presented partially in terms of algorithm and symbolic representation upon operation on data bits within the computer memory. These algorithmic descriptions and representations are the means used by those skilled in the art in the data processing arts to most effectively convey the substance of their work to others skilled in the art.

An algorithm is here, and generally, conceived to be a self-consistent sequence of steps leading to a desired result. These steps are those require physical manipulation of physical quantities. Usually, though not necessarily, these quantities take the form of electrical or magnetic signals capable of being stored, transferred, combined, and otherwise manipulated. In this case, the physical quantities are voltage signals which correspond to the speech signals. It proves convenient at times, principally for reason of common usage, to refer to these signals as bits, values, elements, symbols, characters, terms, numbers or the like. It should be borne in mind, however, hat all of these and similar terms are to be associated with the appropriate physical quantities and are merely convenient labels applied to these quantities.

Further, the manipulations performed are often referred to in terms such as adding or comparing, which are commonly associated with the mental operations performed by a human operator. No such capability of a human operator is necessary, or desirable. In most cases, in any of the operations described herein which form part of the present invention; the operations are machine operations. Useful machines for performing the operations of the present invention include general purpose digital computers or similar devices such as digital signal processors. In all cases, it should be borne in mind that there is a distinction between the method operation in operating a computer and the method of computation itself. The present invention relates to method steps for operating a computer in processing position signals of the rack relative to the leg rack teeth to generate other desired physical signals.

The present invention also relates to an apparatus for performing these operations. This apparatus may be specially constructed for the required purpose or it may comprise a general purpose computer as selectively activated or reconfigured by a computer program stores in the computer. The algorithms presented herein are not inherently related to any particular computer or other apparatus. In particular, various general purpose machines may be used with programs written in accordance with the teachings herein, or it may prove more convenient to construct specialized apparatus such as digital signal processor to perform the required method steps. The required structure for a variety of these machines would appear from the description given below.

PREFERRED EMBODIMENT OF THE PRESENT INVENTION

FIG. 1 is a side, elevational view of a prior art rack chock fixation system for jackup rig. System 10 illustrates a prior art rack chock fixation device as taught in U.S. Pat. No. Re. 32,589 where vertical screw jacks 12 and horizontal screw jacks 14 align a teeth section 11 of a rack chock piece with a matching teeth profile 21 on the leg rack 20. Once aligned, the rack chock 10 and the leg rack 20 are locked by screw jacks. The alignment is accomplished manually and visually. Furthermore, the prior art fixation system described in FIG. 1 arrests primarily two degrees of relative movements between the rack chock and leg rack.

Figure 2A:
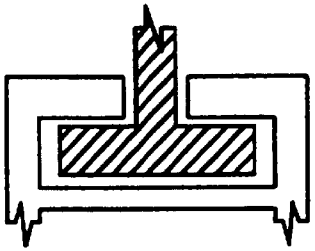
FIG. 2 is a side, elevational view of another prior art locking system for jackup rig.
Figure 2:
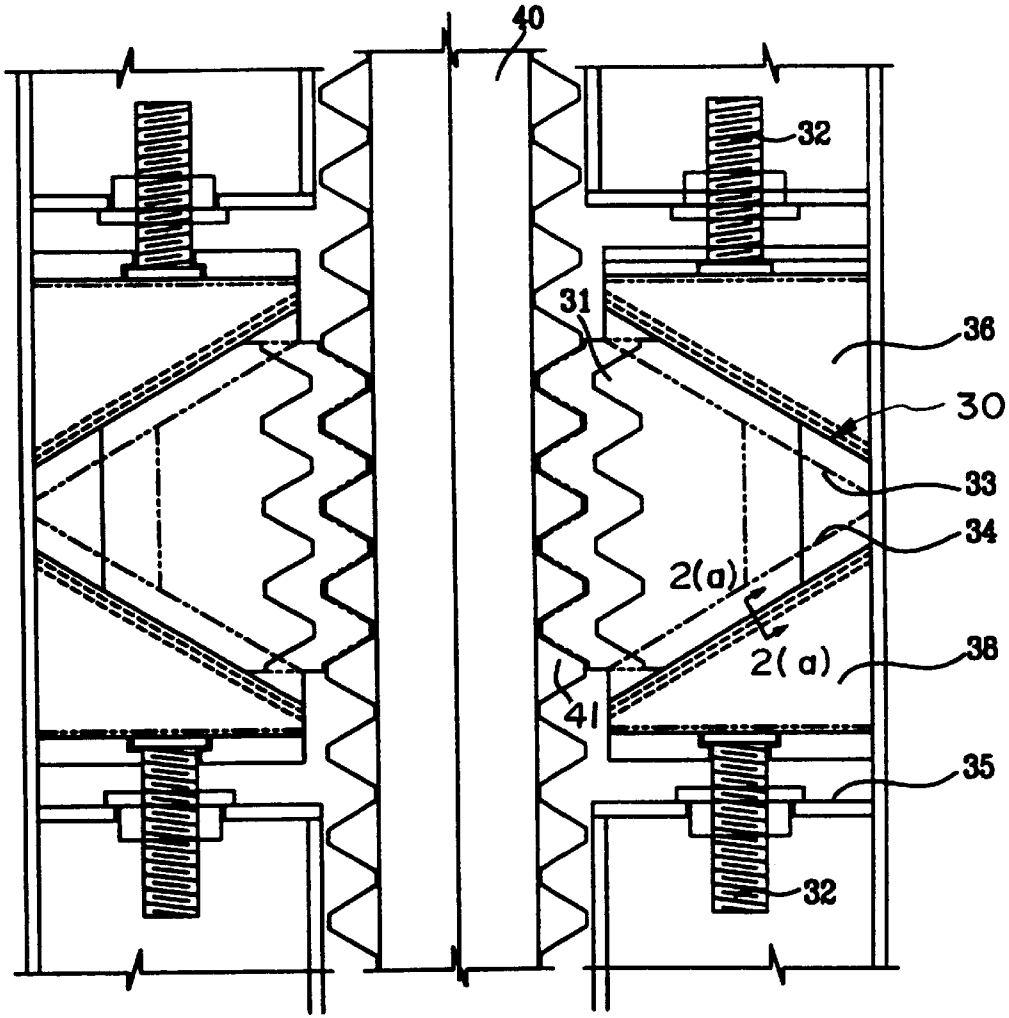
FIG. 2 (PRIOR ART)

FIG. 2 is a side, elevational view of another prior art locking system for jackup rig. Locking system 30 teaches the use of a counter rack with inclined upper surface 33 and lower surface 34 with "T" extensions held between claws of vertically movable wedges 36 and 38 with mating surface and matching inclination. The wedges 36 and 38 are guided to move vertically by nuts fixed into the wedges. The counter rack piece is engaged with mating teeth 41 on the leg rack 40 by independent rotating screws 32. Rotation of the screws with identical speed in the same direction moves the wedges as well as the counter rack vertically. Rotation of the screws with identical speed in the opposite direction brings the wedges closer and moves the counter rack piece laterally by sliding along the inclined surfaces. Like the prior art rack chock fixation in FIG. 1, the locking fixation system 30 requires visual monitoring for the exact matching of the rack chock teeth 31 with the teeth 41 of the leg rack.

Figure 3A:
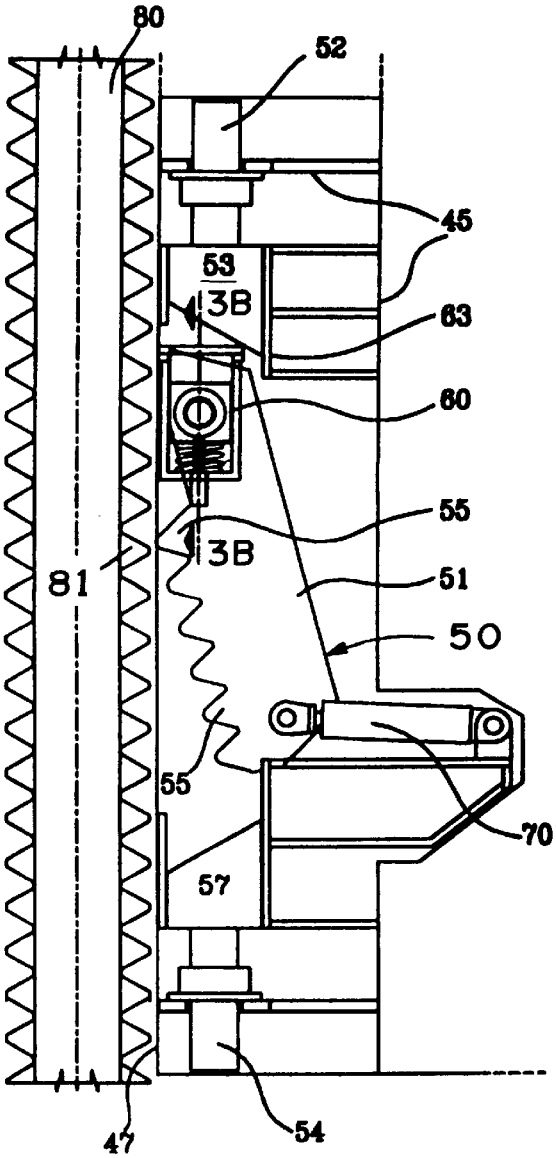
FIG. 3A is side, elevational view of the rack chock system of the present invention.

FIG. 3A is side, elevational view of the rack chock system of the present invention. The rack chock system 50 of the present invention comprises a rack chock 51, a pin and cross head assembly 60, and an actuator assembly 70. The rack chock system 50 is coupled to the jack foundation 45 and in the vicinity of a leg well 47 for engaging and disengaging a leg rack 80. It should be understood by one skilled in the art that the legs are raised or lowered through a plurality of leg wells in a jackup rig. Referring again to FIG. 3A, the rack chock 51 is coupled pivotally at one end to the pin and cross head assembly 60 for engaging and disengaging the leg rack 80 without visual inspection and manual control. The other end of the rack chock 51 is coupled to one end of an actuator assembly 70 for engaging and disengaging the rack chock system 50. Along the edge of the rack chock closer to the leg rack is a set of matching teeth 55 for mating with the teeth 81 of the leg rack 80.

Figure 3B:
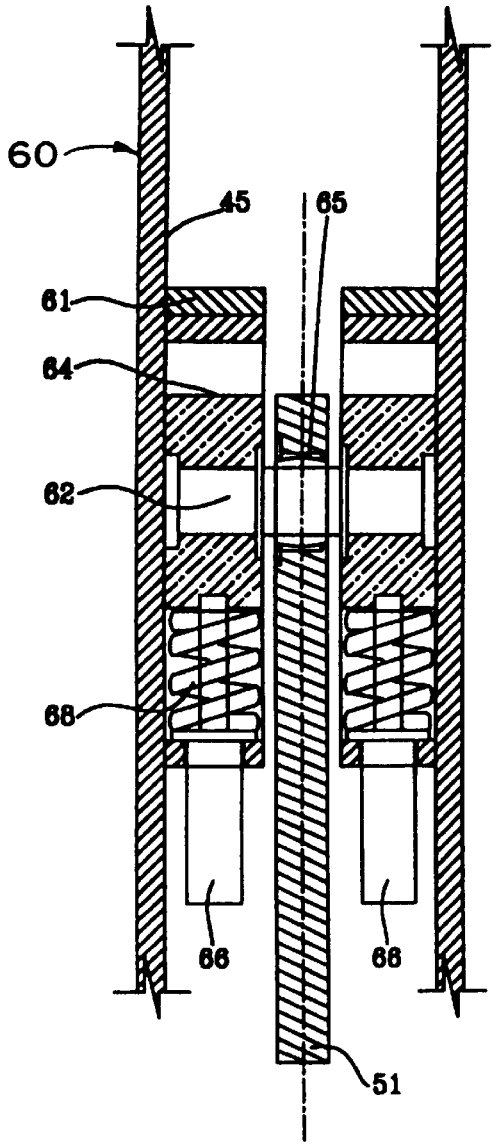
FIG. 3B is exploded, cross section, elevational view of the pin and cross head assembly of the rack chock system according to Section A—A in FIG. 3A.

FIG. 3B is exploded, cross section, elevational view of the pin and cross head assembly of the rack chock system according to Section A—A in FIG. 3A. The pin and cross head assembly 60 comprises a guide casing 61, pin 62, cross heads 64, spherical bearings 65, push cylinders 66 and springs 68. As mentioned above in connection with the description of FIG. 3A, one end of the rack chock is coupled pivotally with the pin for engaging and disengaging in a in-line fashion the leg rack (not shown in FIG. 3B) without visual monitoring and manual control. The pin and cross head assembly 60 aligns the teeth of the rack chock automatically with that of the leg rack. In FIG. 3B one end of the rack chock 51 is coupled pivotally to a pin 62 disposed between two cross heads 64. The pin 62 is supported and arrested against rotation in the cross heads 64. The pin 62 also acts as an axis of rotation for the rack chock 51. The cross heads 64 are disposed slidably within the guide casing 61 which in turn is coupled to the jack foundation 45. The cross heads 64 slide up and down between the guides 63 in a direction parallel with the longitudinal axis of the leg rack 80. Push cylinders 66 are disposed in the guide casing 61 to push against and position the cross heads 64 when it is necessary. These push cylinders 66 are normally in a retracted position. Disposed between the cross heads 64 and the guide casing 61 are springs for positioning the cross heads 64 in an equilibrium position within the guide casing.

Figure 4B:
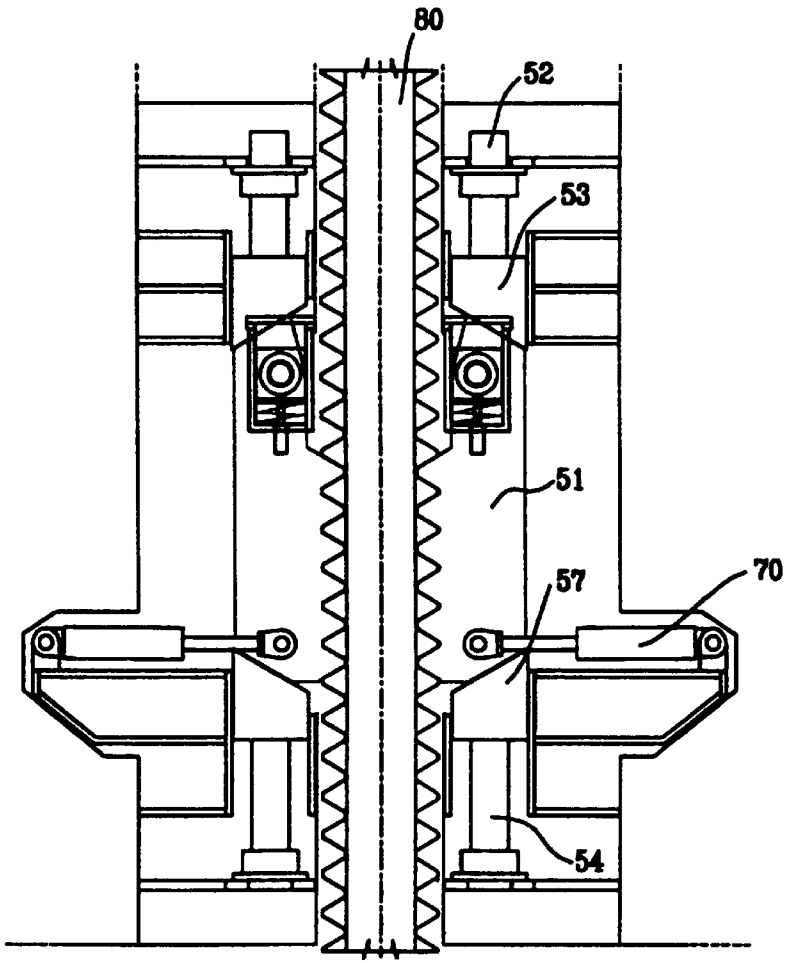
FIG. 4B is a side, elevational view of the embodiment of the present invention being employed to lock an opposing pinion type leg rack.
Figure 4A:
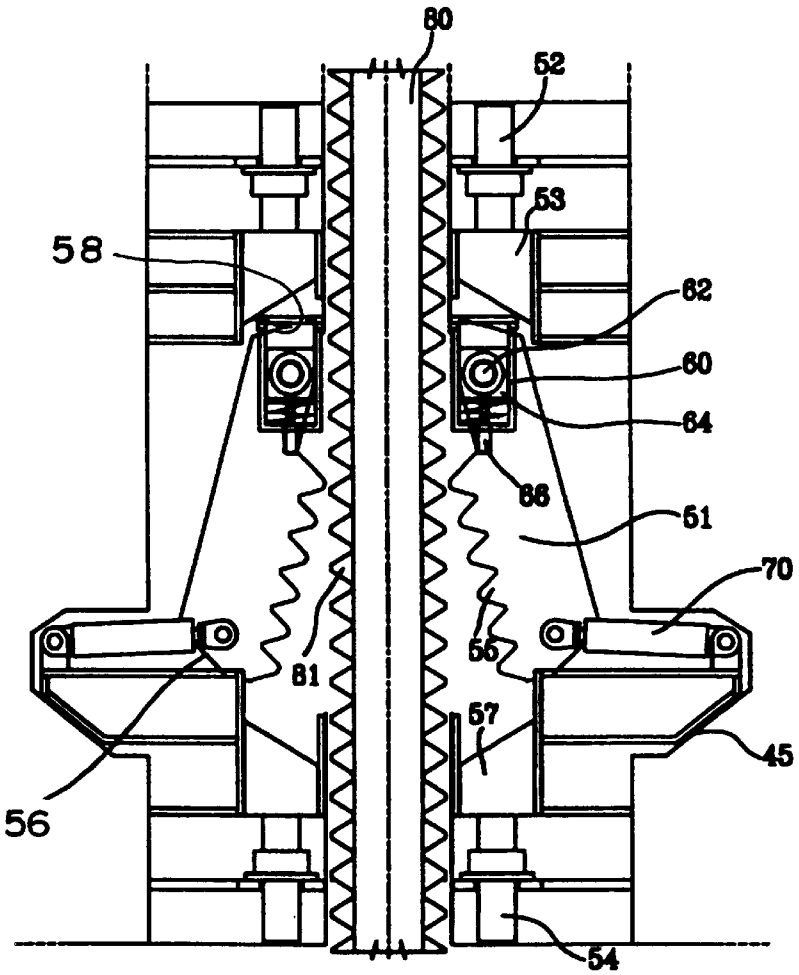
FIG. 4A is a side, elevational view of an embodiment of the present invention being employed to engage an opposing pinion type leg rack.

FIG. 4A shows a side, elevational view of an embodiment of the present invention being employed to engage an opposing pinion type leg rack. A pair of rack chock systems 50 according to the present invention are shown engaging an opposing pinion type leg rack 80. As the leg rack and rack chock system is symmetrical, the rest of the description of the present invention shall concentrate on elaborating on the rack chock system on the right hand side. As mentioned in FIG. 3A, one end of the rack chock 51 is coupled pivotally and slidably with the pin and cross head assembly 60 to engage the leg rack without visual monitoring and manual control. The mechanism for engaging the rack chock 51 to the leg rack is carried out by the actuator assembly 70. The end of the rack chock 51 opposite the pin and cross heads assembly is coupled to one end of the actuator assembly 70. The other end of the actuator assembly 70 is coupled to the jack foundation 45. In one embodiment of the present invention, the actuator assembly 70 comprises a piston and cylinder assembly. It should be understood by one skilled in the art that other actuator assemblies may be employed to engage and disengage the rack chock system of the present invention.

FIG. 4B is a side, elevational view of the embodiment of the present invention being employed to lock an opposing pinion type leg rack. Once the teeth 55 of the rack chock engages and matches the teeth 81 of the leg rack, wedges 53 and 57 are urged by jacks 52 and 54 respectively to lock the rack chock and leg rack assembly. The rack chock 51 has edges 56 and 58 which matches the profile of the surfaces of wedges 57 and 53 respectively. The tooth crest of the edge 56 has rounded surfaces to cooperate with the inclined surfaces of the wedge 57. As such, the relative movement between the rack chock 51 and the leg rack 80 is minimized. Although the jacks 52 and 54 are illustrated as opposing each other in FIGS. 4A and 4B respectively, it should be understood by one skilled in the art that other positions are possible. For example, the guide surfaces of the wedges may be altered such that the jacks are parallel to each other.

Figure 5:
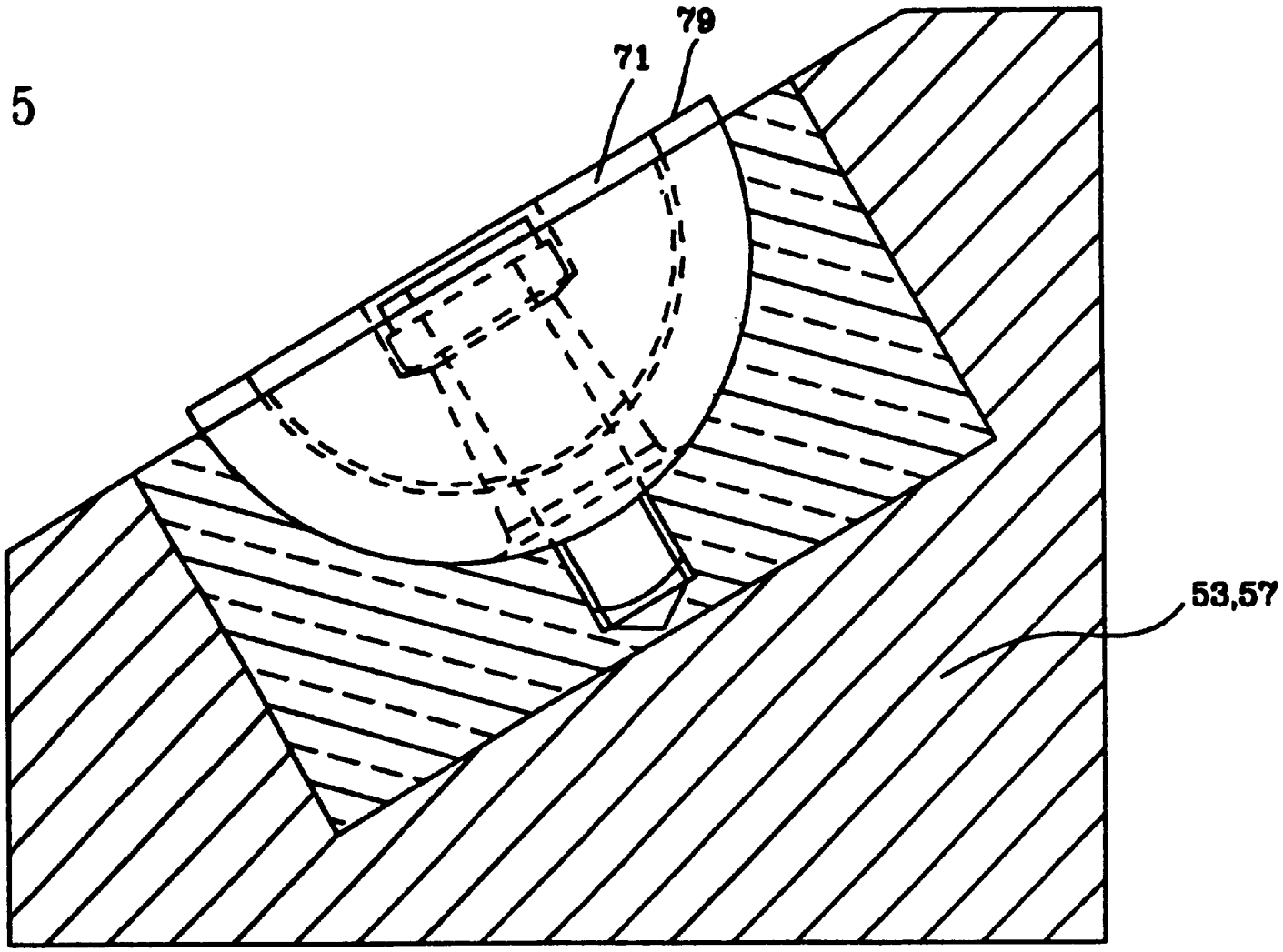
FIG. 5 is cross section, elevational view of the wedge of the present invention.

It is said that the prior art fixation systems described in FIGS. 1 and 2 arrest all possible degrees of relative movements between the rack chock and leg rack. FIG. 5 is a cross section, elevational view of a locking wedge of the present invention for arresting more than two degrees of relative movements between the rack chock and leg rack. Accordingly, the flat surface of a hemisphere 71 is disposed slightly raised above the inclined surfaces of the locking wedges 53 and 57. The hemisphere 71 is secured to a bearing housing 75 with a fastener 72. The curved surface of the hemisphere and the curved interior of the bearing housing 78 form a pair of mating surfaces. These surfaces function as a bearing assembly within locking wedges 53 and 57 and permit them to engage with the flat surface 79 tilting. These surfaces also provide maximum surface contact with the inclined surface of rack chock on which they converge, regardless of the rack chock's position. As such, the locking wedges 53 and 57 transfer the loads from the jack foundation to the leg assembly or vice versa even when the leg chock assembly and consequently the inclined surface of the engaged rack chock are mis-aligned with inclined surfaces of the locking wedges.

Figure 6:
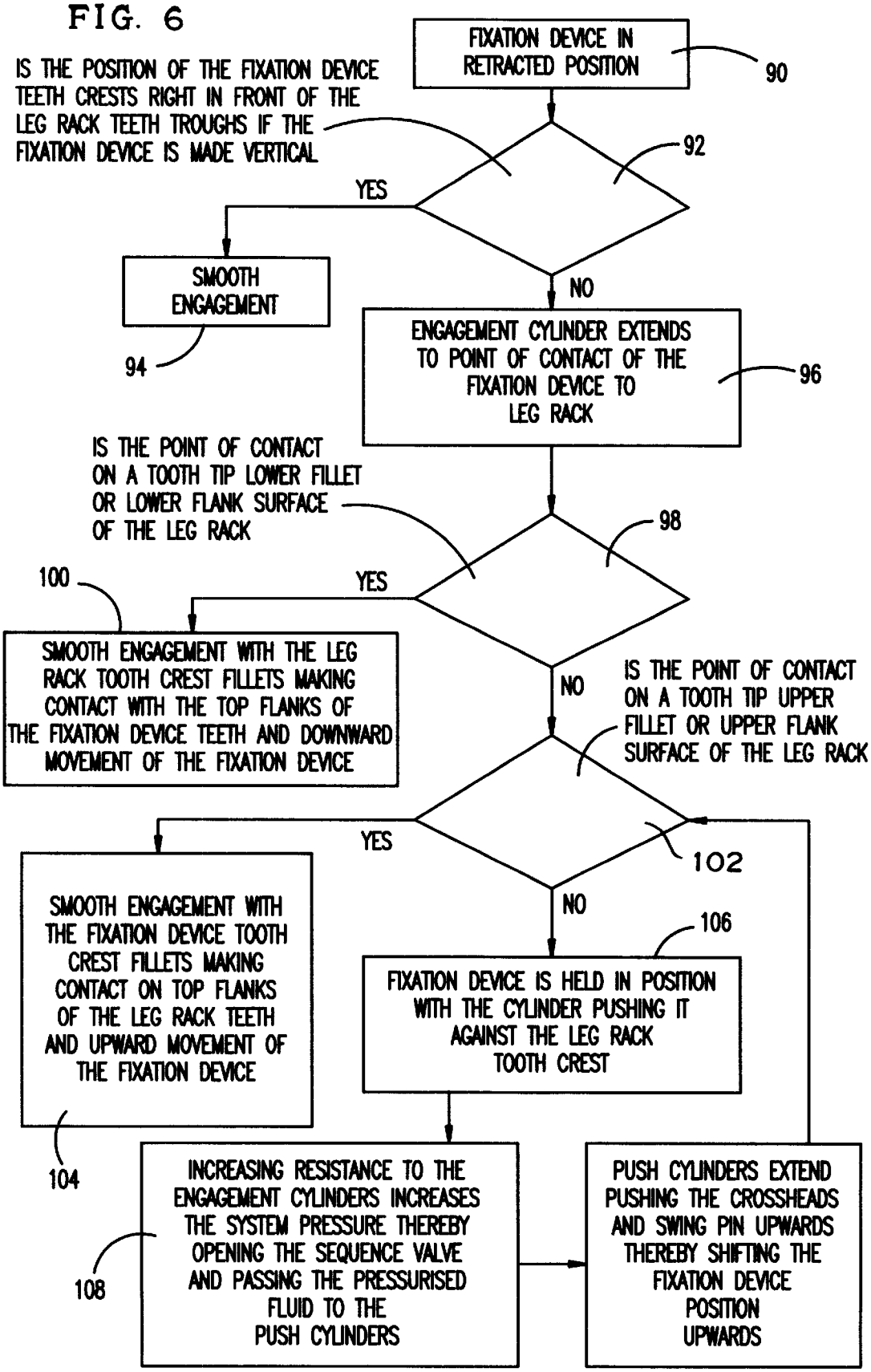
FIG. 6 is a flow chart illustrating the steps under which the present invention aligns and engages a leg rack of a self elevating platform automatically.

FIG. 6 is a flow chart illustrating the steps under which the present invention aligns and engages a leg rack of a self elevating platform automatically. The followings steps are carried out without visual monitoring and manual control. Feedback and corrective action only occur when the landing of the teeth of rack chock make contact with the crest of the leg rack teeth. Referring again to FIG. 6, the process of engagement begins in step 90 with the actuator assembly 70 in a fully retracted position initially. Then in step 92 the process determines whether the flanks of rack chock teeth 55 allows proper mating with those of the leg rack teeth 81 when the rack chock is parallel with the leg rack. If yes, then no further alignment is needed and the rack chock may engage with the leg rack in step 94. If no, the actuator assembly extends in step 96 to the point of contact of rack chock teeth with that of the leg rack teeth. From the displacement of the actuator assembly 70, the process determines in step 98 whether the crest radius of the rack chock teeth 55 is over the bottom crest fillet or bottom flank of the leg rack teeth 81. In such a case, the process extends the actuator assembly 70 further in step 100 such that the rack chock teeth 55 is urged to follow the path of least resistant along the flank contours of the teeth 55 and 81 to the engagement position. In step 102 the process determines whether the crest radius of the rack chock teeth 55 contacts the top crest fillet or top flank of the leg rack teeth 81. If so, the process extends the actuator assembly 70 further in step 104 such that the rack chock teeth 55 is urged to follow the path of least resistant to the engagement position. Otherwise in step 106, the rack chock teeth 55 presses against the leg rack teeth 81 on the crest landing and no further movement of the rack chock is possible regardless of how strongly the actuator assembly 70 is extended. This feedback signal is passed in step 108 to the push cylinders 66 which are then activated to push the pin and cross head assembly 60 upwards. As a result, the point of contact between teeth 55 and 81 is shifted to the position in step 102 where the actuator assembly can extend the rack chock system to an engagement position.

While the present invention has been described particularly with reference to FIGS. 1 to 6 with emphasis on a system for automatically engaging and arresting the relative movement between the supporting legs and jack foundation of self elevating platform, it should be understood that the figures are for illustration only and should not be taken a limitation on the invention. In addition, it is clear that the method and apparatus of the present invention has utility in many applications where self-positioning system is required. It is contemplated that many changes and modifications may be made by one of ordinary skill in the art without departing from the spirit and the scope of the invention as described.

We claim:

1. A fixation system for a self elevating platform, said system including at least one platform having at least one leg well for receiving at least one leg there through, said at least one leg well being integrated with a jack foundation wherein at least one rack and pinion jacking system is disposed thereon for raising and lowering said at least one leg through said at least one leg well, said at least one leg further having a plurality of leg racks, each said leg rack having at least one set of rack teeth attached longitudinally thereto, said at least one set of teeth having inclined surfaces being engagable with said rack and pinion jacking system, said fixation system comprising:

a rack chock having on at least one edge a set of teeth for mating with that of said leg rack, said rack chock further having an Inclined edge;

a pin and cross head assembly disposed between said plurality of leg racks and said jack foundation for supporting pivotally and tiltably one end of said rack chock, said pin and cross head assembly further being restrained by a pin disposed within a guide for allowing said rack chock at least two degrees of movement in a direction parallel with the longitudinal axes of said plurality of leg racks such that the rack chock teeth engage in-line with those of said plurality of leg racks;

an actuator assembly having one end fixed to the jack foundation and the other end being coupled to the other end of said rack chock for positioning said rack chock with said plurality of leg racks; and at least one pair of jacks having wedges for restraining said rack chock once it engages said leg rack, each said wedge having an inclined surface, whereby said fixation system for a self elevating platform automatically arrests the relative movement between said at least one leg and said jack foundation while minimizing stress on the mating surfaces thereof.

2. A fixation system for a self elevating platform according to claim 1 wherein said rack chock has at its tooth crests rounded surfaces which cooperate with the inclined surfaces of said at least one set of leg rack teeth.

3. A fixation system for a self elevating platform according to claim 1 wherein a pin is supported at either end in said pin and cross head assembly.

4. A fixation system for a self elevating platform according to claim 3 wherein said rack chock is supported on said pin with at least one spherical bearing for aligning the rack chock with the leg rack.

5. A fixation system for a self elevating platform according to claim 3 wherein said pin and cross head assembly is held at an equilibrium position within said guide with springs.

6. A fixation system for a self elevating platform according to claim 1 wherein said guide is coupled to said jack foundation.

7. A fixation system for a self elevating platform according to claim 1 wherein said at least one pair of jacks is coupled to said jack foundation.

8. A fixation system for a self elevating platform according to claim 1 wherein said wedges have within internal curved bearing housing hemispheres with their top surface slightly raised above the inclined surfaces of the wedges, said wedges being tiltable for imposing maximum restraining edge contact with the inclined surfaces of the rack chock on which it converges and engages.

9. A method of engaging and locking a rack chock with a leg rack of a rack and pinion jacking system of a self elevating system platform, said platform having at least one leg well for receiving at least one leg there through, said at least one leg well further being integrated with a jack foundation wherein said rack and pinion jacking system is disposed, said method comprising the steps of:

pivoting one end of said rack chock with a pin and cross head assembly, said rack chock having on at least one edge a set of teeth for mating with teeth of said leg rack, said pin and cross head assembly having at least one cross head and at least one push cylinder within a guide casing for allowing said rack chock at least two degrees of movement in a direction parallel with the longitudinal axis of said leg rack such that the rack chock teeth engage in-line with those of said leg rack;

extending said rack chock to engage or disengage said leg rack with an actuator assembly, said actuator assembly having one end coupled to the other end of said rack chock, said actuator assembly further having the other end coupled to the jack foundation;

determining upon the first contact between the rack chock teeth and leg rack teeth whether said rack chock fully engages said leg rack;

extending said actuator assembly further to urge said rack chock teeth along flank surfaces of said leg rack teeth if said rack chock does not fully engage said leg rack; and activating said at least one push cylinder to position the rack chock such that the rack chock teeth are engagable along flank surfaces of said teeth if the crest radii of the rack chock teeth are right over the crest landing of leg rack teeth, whereby said method for engaging and locking the self elevating platform arrests automatically the relative movement between said at least one leg and said jack foundation while minimizing stress on the mating surfaces thereof.

10. A method of engaging and locking a rack chock with the leg rack of a rack and pinion jacking system according to claim 9 wherein said step of pivoting one end of said rack chock with a pin and cross head assembly comprises automatically engaging rounded surfaces of tooth crests of said rack chock with inclined surfaces of said leg rack teeth.

11. A method of engaging and locking a rack chock with the leg rack of a rack and pinion jacking system according to claim 9 wherein said step of pivoting one end of said rack chock with a pin and cross head assembly comprises supporting a pin at either end in said pin and cross head assembly.

12. A method of engaging and locking a rack chock with the leg rack of a rack and pinion jacking system according to claim 11 comprising supporting said rock chock on said pin with at least one spherical bearing for aligning the rack chock with the leg rack.

13. A method of engaging and locking a rack chock with the leg rack of a rack and pinion jacking system according to claim 11 comprising the step of holding said at least one pin and cross head in an equilibrium position within said guide casing with springs.

14. A method of engaging and locking a rack chock with the leg rack of a rack and pinion jacking system according to claim 9 comprising the step of coupling said guide casing to said jack foundation.

15. A method of engaging and locking a rack chock with the leg rack of a rack and pinion jacking system according to claim 9 comprising the step of coupling at least one pair of jacks to said jack foundation.

* * * * *